US006262682B1

(12) United States Patent
Shibata

(10) Patent No.: US 6,262,682 B1
(45) Date of Patent: Jul. 17, 2001

(54) MICRO-STRIP ANTENNA

(75) Inventor: Masaki Shibata, Ise (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 0 days.

(21) Appl. No.: 09/493,615

(22) Filed: Jan. 28, 2000

(30) Foreign Application Priority Data

Feb. 17, 1999 (JP) ..... 11-038978

(51) Int. Cl.[7] ..... H01Q 1/38
(52) U.S. Cl. ..... 343/700 MS; 343/702
(58) Field of Search ..... 343/700 MS, 702

(56) References Cited

U.S. PATENT DOCUMENTS 5,691,732 * 11/1997 Tsuru et al. ..... 343/745
5,867,126 * 2/1999 Kawahata et al. ..... 343/702
6,140,968 * 10/2000 Kawahata et al. ..... 343/700 MS

FOREIGN PATENT DOCUMENTS 62-66703 3/1987 (JP) .

OTHER PUBLICATIONS

Yeh, The Journal of Biological Chemistry 271 (6):2921–8, Feb. 1996.*

Morrison, in Advances in Immunology 44:65–92, Academic Press, Inc, 1989.*

White, M.F. et al., "The Insulin Signaling System", *J. Biol. Chem.,* 269: 1–4 (1994).

Almind, K. et al., "A Common Amino Acid Polymorphism in Insulin Receptor Substrate–1 Causes Impaired Insulin Signaling", *J. Clin. Invest.,* 97: 2569–2575 (1996).

Yeh, T. et al., "Characterization and Cloning of a 58/53–kDa Substrate of the Insulin Receptor Tyrosine Kinase", *J. Biol. Chem.,* 271: 2921–2928 (1996) (GI 1203820).

Stoffel, M. et al., "Human insulin receptor substrate–1 gene (*IRS1*): chromosomal localization to 2q35–q36.1 and identification of a simple tandem repeat DNA polymorphism", *Diabetologia,* 36: 335–337 (1993).

Yeh, T.C. et al., (Direct Submission), GenBank Sequence Database (Accession 1203820), National Center for Biotechnology Information, National Library of Medicine, Bethesda, Maryland, 20894 (GI 1203820), Feb. 26, 1996.

Hillier et al., Accession No. R55195, The WashU–Merck EST project (May 22, 1995).

Marra et al. Accession No. AA061801 (The Marra M/Mouse EST Project) (Sep. 23, 1996).

Hillier et al., Accession No. AA235829, The WashU–Merck EST project Mar. 6, 1997).

* cited by examiner

*Primary Examiner*—Don Wong
*Assistant Examiner*—James Clinger
(74) *Attorney, Agent, or Firm*—Larson & Taylor, PLC

(57) ABSTRACT

A micro-strip antenna includes a dielectric substrate, a radiation conductor disposed on one main face of the dielectric substrate, a ground conductor disposed on the opposite main face of the dielectric substrate, and at least one reactance compensation electrode disposed on a side face of the dielectric substrate and connected to the radiation conductor or the ground conductor. Through adjustment of the shape and length of the reactance compensation electrode, the input impedance of the micro-strip antenna is matched to a feed line. The reactance compensation electrode serves as a reactance compensation circuit element.

7 Claims, 7 Drawing Sheets

INPUT IMPEDANCE: 44.2 Ω

INPUT IMPEDANCE: 47.5 Ω

INPUT IMPEDANCE: 49.8 Ω

MICRO-STRIP ANTENNA

BACKGROUND OF THE INVENTION

1. Field of the Invention

The present invention relates to a micro-strip antenna for use in a mobile communication apparatus, such as an airborne communication apparatus, a mobile telephone, or a cellular phone.

2. Description of the Related Art

A micro-strip antenna in which a radiation conductor is disposed on one main face of a dielectric substrate, and a ground conductor is disposed on the opposite main face of the substrate is compact, light, and thin. Therefore, such a micro-strip antenna is suitably used as an antenna member for use in a small-sized mobile communication apparatus, such as an airborne communication apparatus, a mobile telephone, or a cellular phone.

As shown in FIG. 7, a rectangular micro-strip antenna a includes a dielectric substrate b, a radiation conductor c formed on one main face of the substrate b, and a ground conductor d formed on the opposite main face of the substrate b. A through-hole e is formed in the dielectric substrate b and serves as a feed line to the radiation conductor c. Being energized via the through-hole e (feed point), the radiation conductor c radiates electromagnetic waves from its peripheral open ends. The thus-radiated electromagnetic waves are in the form of, for example, linearly polarized waves.

Reflection characteristics of the micro-strip antenna having the above structure vary greatly with input impedance. If input impedance fails to suitably match a 50Ω feed line, reflection characteristics will be degraded. As a result, the center frequency of a signal to be transmitted or received may deviate from the resonance frequency of the micro-strip antenna, potentially failing to efficiently transmit or receive electromagnetic waves.

For the reasons set forth above, a micro-strip antenna of the kind being considered here must employ means for matching its input impedance to the 50Ω feed line. Such a means is disclosed in, for example, Japanese Patent Application Laid-Open (kokai) No. 62-66703. According to this publication, a dielectric substrate is sandwiched between a radiation conductor b and a ground conductor c. A conductive plate is embedded in the dielectric substrate in parallel with the conductors b and c, and a feed line is electrically connected to the conductive plate and the ground conductor c. The conductive plate serves as a reactance compensation circuit element for changing the input impedance characteristics of the micro-strip antenna so as to suppress reflection characteristics in a predetermined band assigned to mobile communication apparatus and thus enabling implementation of a wide-band micro-strip antenna.

An important disadvantage of the above-described matching means is that the conductive plate must be embedded in the dielectric substrate, so that the resultant structure is relatively complex. As a consequence, fabrication of such micro-strip antennas is also relatively complex and difficult. Further, because the conductive plate is embedded in the dielectric substrate, the conductive plate cannot be adjusted from the outside.

SUMMARY OF THE INVENTION

An object of the present invention is to solve the above-mentioned problems associated with conventional micro-strip antennas.

To achieve the above object, according to the present invention, a micro-strip antenna is provided comprising: a dielectric substrate; a radiation conductor disposed on one main face of the dielectric substrate; a ground conductor disposed on the opposite main face of the dielectric substrate; and a reactance compensation electrode disposed on a side face of the dielectric substrate and connected to the radiation conductor or the ground conductor. The reactance compensation electrode is adapted to match the input impedance of the micro-strip antenna to a feed line.

The reactance compensation electrode creates or generates an inductance component by itself and generates a capacitance component in cooperation with an opposed conductor, and thus the compensation electrode essentially functions as a reactance compensation circuit element. Varying the length or shape of the reactance compensation electrode varies the reactance component X of input impedance Z ($Z=R+jX$). Accordingly, through adjustment of the length or shape of the reactance compensation electrode, the input impedance of the micro-strip antenna can be made to match a 50Ω feed line.

Instead of using a single reactance compensation electrode connected to either the radiation conductor or the ground conductor, an advantageous implementation of the invention employs a first reactance compensation electrode connected to the ground conductor and a second reactance compensation electrode connected to the radiation conductor, with electrodes disposed in a mutually opposing manner. In this configuration, stray capacitance is generated between the first and second reactance compensation electrodes, and the input impedance of the micro-strip antenna can be adjusted through modification of the length of either compensation electrode, thus increasing the number of parameters that can be varied in providing the input impedance adjustment, and thereby facilitating fine adjustment of the input impedance.

Preferably, the reactance compensation electrode has the shape of a strip electrode disposed in parallel with the main faces of the dielectric substrate. Through adjustment of the length of the strip electrode, the input impedance of the micro-strip antenna can be readily adjusted. The reactance compensation electrode may be of any other shape so long as the electrode creates or generates an inductance component in association with that shape and a capacitance component in cooperation with a conductor and so long as these components can be varied or changed to adjust the input impedance.

According to the present invention, the reactance compensation electrode serves as a reactance compensation circuit element, as indicated above. Through modification of the length or shape of the reactance compensation electrode, the reactance component of input impedance can be adjusted, and, in particular, the input impedance can be adjusted to match the 50Ωfeed line. By virtue of this match, the resonance frequency of the micro-strip antenna is made to equal the center frequency of a signal transmitted through the feed line, thereby improving efficiency in transmission or reception of electromagnetic waves.

Because the input impedance can be matched to the 50Ω feed line through the provision of the reactance compensation electrode having an appropriate length or shape on a side face of the dielectric substrate, the basic micro-strip antenna construction remains the same, i.e., the resultant micro-strip antenna is a simple structure which is easy to fabricate. Since the reactance compensation electrode is formed on the outer surface in an exposed manner, the length of the reactance compensation electrode can be readily adjusted after fabrication of the micro-strip antenna.

Thus, the micro-strip antenna of the invention has a simple structure and excellent operating characteristics, and is optimized for use in a mobile communication apparatus.

BRIEF DESCRIPTION OF THE DRAWINGS

Various other objects, features and many of the attendant advantages of the present invention will be readily appreciated as the same becomes better understood by reference to the following detailed description of the preferred embodiments when considered in connection with the accompanying drawings, in which.

DESCRIPTION OF THE PREFERRED EMBODIMENTS

The structures of three micro-strip antennas, respectively denoted 1*a*, 1*b* and 1*c* in FIGS. 1 and 2, FIG. 3 and FIG. 4, and constructed according to first, second and third embodiments of the present invention, will now be described with reference to FIGS. 1 to 4. Because of the similarities between the three embodiments, the common features thereof will be described together.

Figure 2:
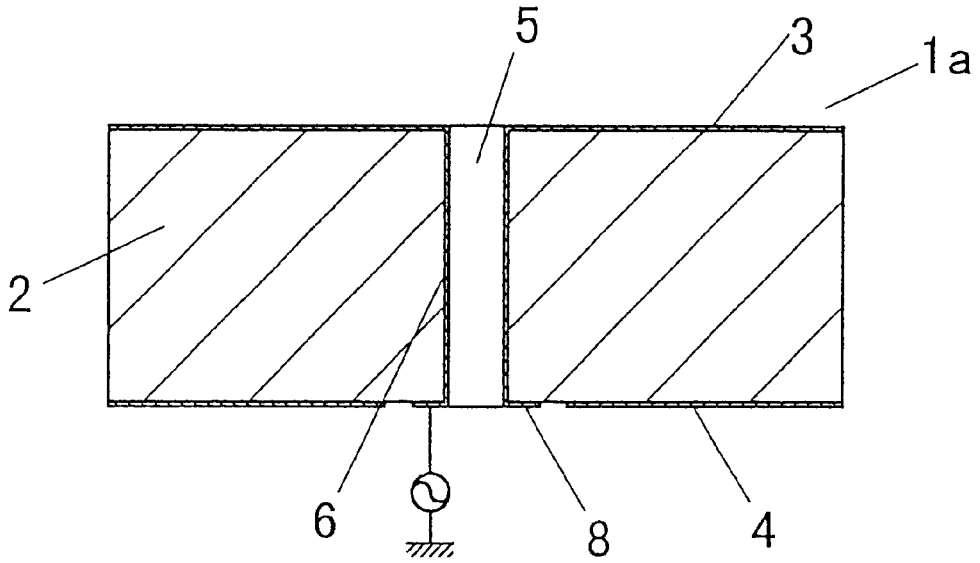
FIG. 2 is a longitudinal cross sectional view of the micro-strip antenna of FIG. 1.

The micro-strip antennas 1*a* to 1*c* each include a dielectric substrate 2, a at radiation conductor 3 formed on one main face of the dielectric substrate 2, and a ground conductor 4 formed on the opposite main face of the dielectric substrate 2. A through-hole 5 is formed in the dielectric substrate 2 and, as shown in FIG. 2, an inner conductor 6 is formed on the wall of the through-hole 5 and connected to the radiation conductor 3. As is also shown in FIG. 2, a feed electrode 8 is formed on the same side of the dielectric substrate 2 as that where the ground conductor 4 is formed, in such a manner as to be insulated from the ground conductor 4. Through electrical connection of the feed electrode 8 to the inner conductor 6, the feed electrode 8 is connected to the radiation conductor 3. An unnumbered 50Ω feed line (see FIG. 2) is connected to the feed electrode 8 in order to transmit and receive signals via the radiation conductor 3.

The dielectric substrate 2 is formed of a dielectric ceramic material having a dielectric constant of 30 to 90, such as $BaO\text{-}TiO_2$. The micro-strip antennas 1*a* to 1*c* measure, for example, approximately 10 mm (length)×approximately 5 mm (width)×approximately 3 mm (thickness). The radiation conductor 3 and the ground conductor 4 are formed on the respective entire faces of the dielectric substrate 2 except for a central portion where the through-hole 5 or the feed electrode 8 is formed.

Figure 1:
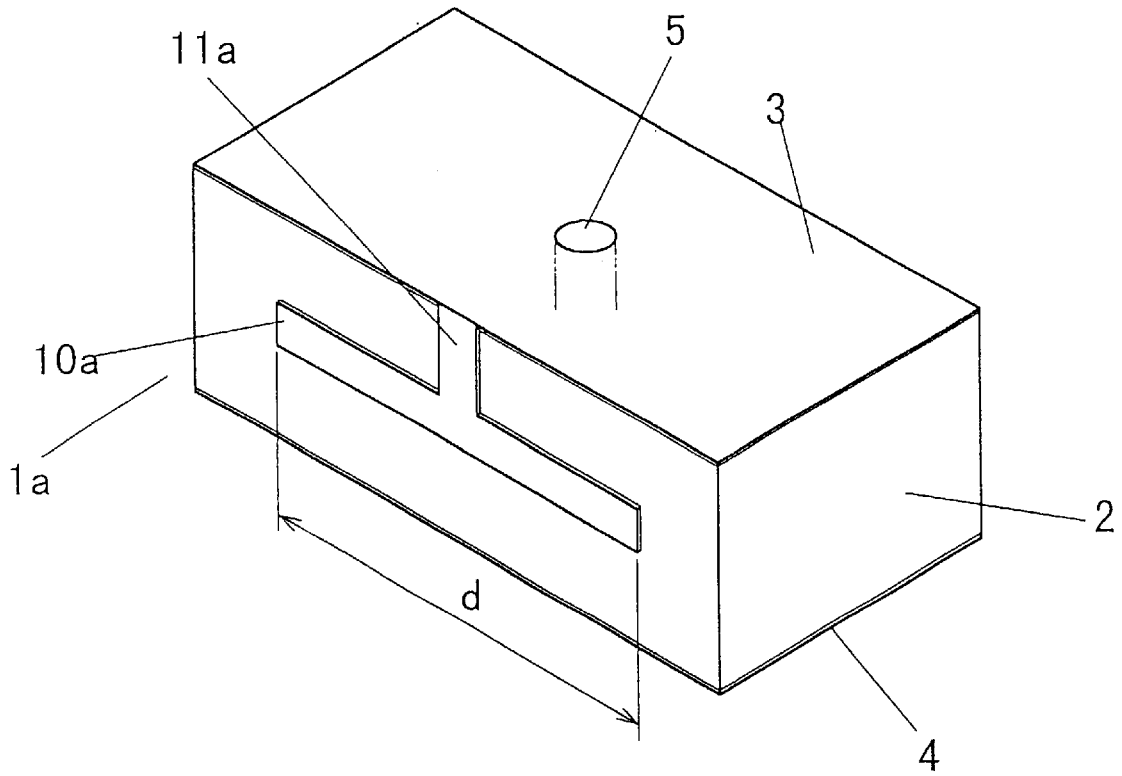
FIG. 1 is a perspective view of a micro-strip antenna according to a first embodiment of the present invention.
Figure 3:
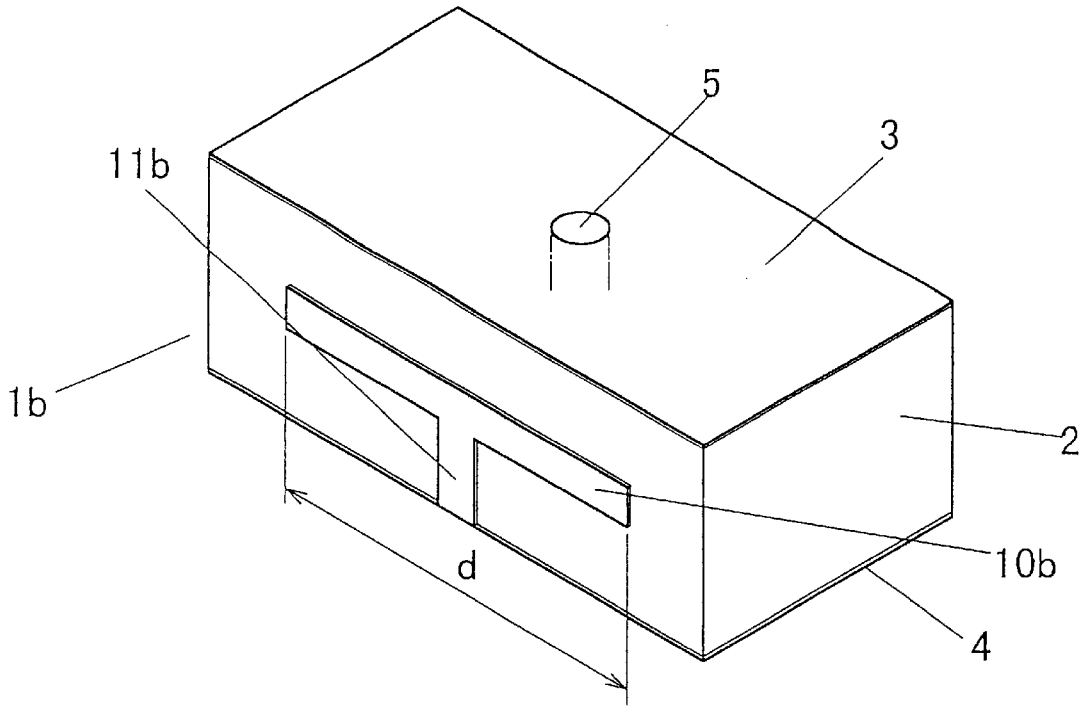
FIG. 3 is a perspective view of a micro-strip antenna according to a second embodiment of the present invention.
Figure 4:
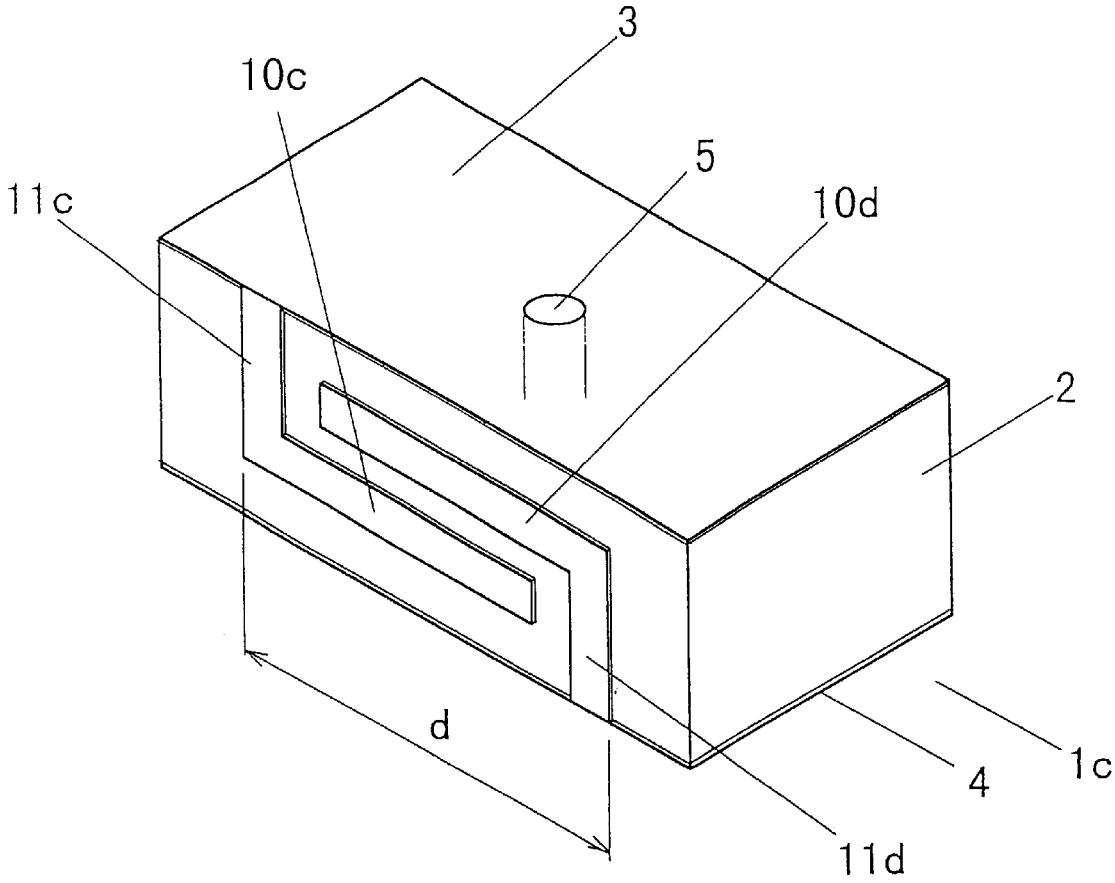
FIG. 4 is a perspective view of a micro-strip antenna according to a third embodiment of the present invention.

As shown in FIGS. 1, 3, and 4, the micro-strip antennas 1*a* to 1*c* each include respective reactance compensation electrodes 10*a*, 10*b*, and 10*c* and 10*d*, respectively.

FIGS. 1 and 2 show the micro-strip antenna 1*a*, which includes the reactance compensation electrode 10*a* formed on a side face of the dielectric substrate 2 and connected to the radiation conductor 3. The reactance compensation electrode 10*a* is formed of a strip electrode which is disposed so as to extend parallel to the radiation conductor 3 and the ground conductor 4 and which is connected electrically to the radiation conductor 3 by a connection portion 11*a*. The reactance compensation electrode 10*a* creates or generates an inductance component by virtue of its length or longitudinal extent and creates or generates a capacitance component in cooperation with the opposed ground conductor 4.

Through adjustment of the length of the reactance compensation electrode 10*a*, the reactance component X of the input impedance Z (Z=R+jX) can be optimized. Through this optimization, the input impedance is made to approximate 50Ω to thereby match the 50Ω feed line. Thus, the resonance frequency of the micro-strip antenna 1*a* can be made equal to the center frequency of a signal transmitted to the radiation conductor 3 through the feed line and then the through-hole 5, thereby improving efficiency in the transmission and/or reception of electromagnetic waves.

FIG. 3 shows the micro-strip antenna 1*b* which includes the reactance compensation electrode 10*b* formed on a side face of the dielectric substrate 2 and connected to the ground conductor 4. The reactance compensation electrode 10*b* is formed as a strip electrode which is disposed in parallel with the radiation conductor 3 and the ground conductor 4 and connected electrically to the ground conductor 4 by means of a connection portion 11*b*. The reactance compensation electrode 10*b* creates or generates an inductance component by means of its length and generates a capacitance component in cooperation with the opposed radiation conductor 3. Through adjustment of the length of the reactance compensation electrode 10*b*, the input impedance can be made to approximate a resistance of 50Ω so as to match the 50Ω feed line. Thus, the resonance frequency of the micro-strip antenna 1*b* can be made equal to the center frequency of a transmitted signal.

FIG. 4 shows the micro-strip antenna 1*c* which includes the first and second reactance compensation electrodes 10*c* and 10*d* formed on a side face of the dielectric substrate 2 and connected, respectively, to the radiation conductor 3 and the ground conductor 4. The reactance compensation electrodes 10*c* and 10*d* are each formed by a strip electrode which is disposed in parallel with the radiation conductor 3 and the ground conductor 4, and the strip electrodes are arranged mutually opposing manner as illustrated. The first reactance compensation electrode 10*c* is electrically connected to the radiation conductor 3 by means of a connection portion 11*c* which extends perpendicularly to the first electrode 10*c* from one end portion of the electrode 10*c*. The second reactance compensation electrode 10*d* is electrically connected to the ground conductor 4 by means of a connection portion 11*d* which extends perpendicularly to the second electrode 10*d* from one end portion of the second electrode 10*d*, this one end being arranged opposite to the above-described one end portion of the first electrode 10*c*. The reactance compensation electrodes 10*c* and 10*d* each create or generate an inductance component by virtue of their length and longitudinal extent and cooperatively create or generate a capacitance component. Through adjustment of the length of the reactance compensation electrodes 10*c* and 10*d*, the reactance component of the input impedance can be optimized. Through this optimization, the input impedance can be made to approximate a resistance of 50Ω so as to match the resistance of the 50Ω feed line. Thus, the resonance frequency of the micro-strip antenna 1*c* can be made to equal to the center frequency of a transmitted signal. The input impedance can be adjusted through modification of the length of either or both of the reactance compensation electrodes 10*c* and 10*d*. Thus, this embodiment provides an increase in the number of variable factors in relation to the input impedance adjustment and thus enables fine adjustment of input impedance.

The reactance compensation electrodes 10*a* to 10*d* are preferably formed through screen printing by use of silver paste. Since the micro-strip antennas 1*a* to 1*c* are each of rectangular construction, a side face of the dielectric substrate 2 is flat and this facilitates formation of the reactance compensation electrode 10 by screen printing.

Figure 5A:
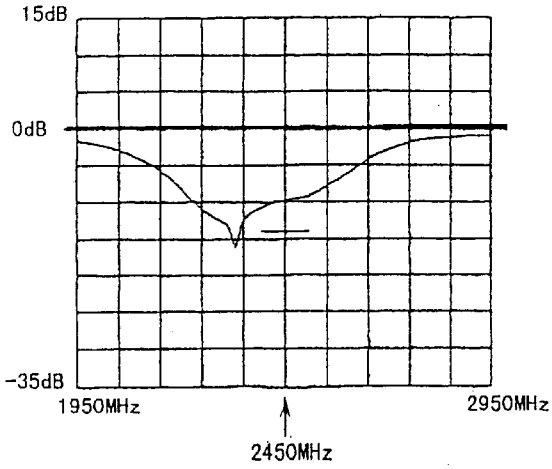
FIGS. 5A to 5C are graphs showing variation in reflection characteristics of the micro-strip antenna of FIG. 1 when the length of the reactance compensation electrode is changed.
Figure 5B:
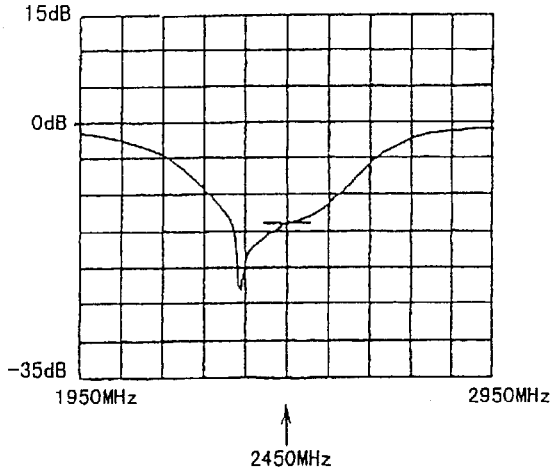
Figure 5C:
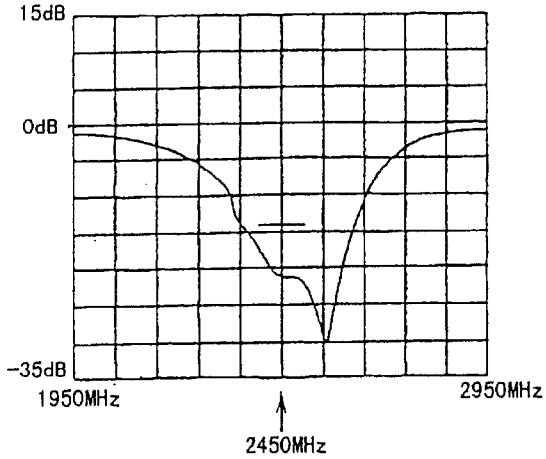
Figure 6A:
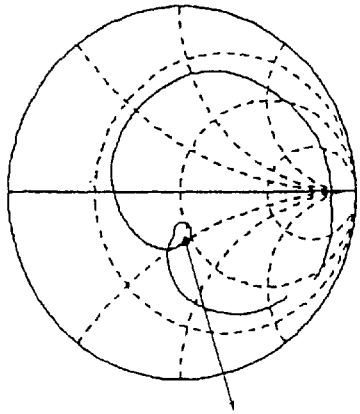
FIGS. 6A to 6C are Smith charts showing variation in reflection characteristics of the micro-strip antenna of FIG. 1 when the length of the reactance compensation electrode is changed.
Figure 6B:
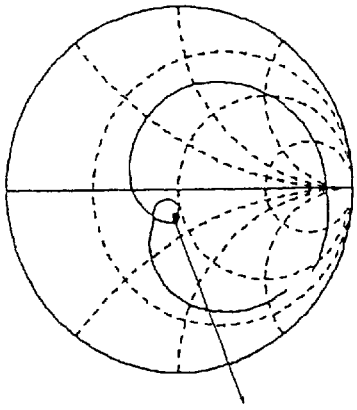
Figure 6C:
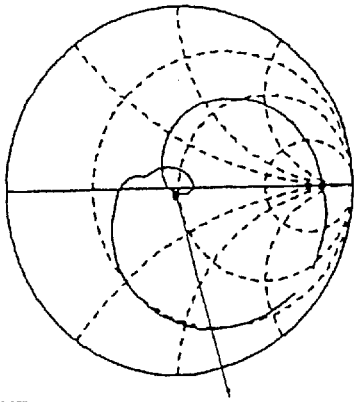
Figure 7:
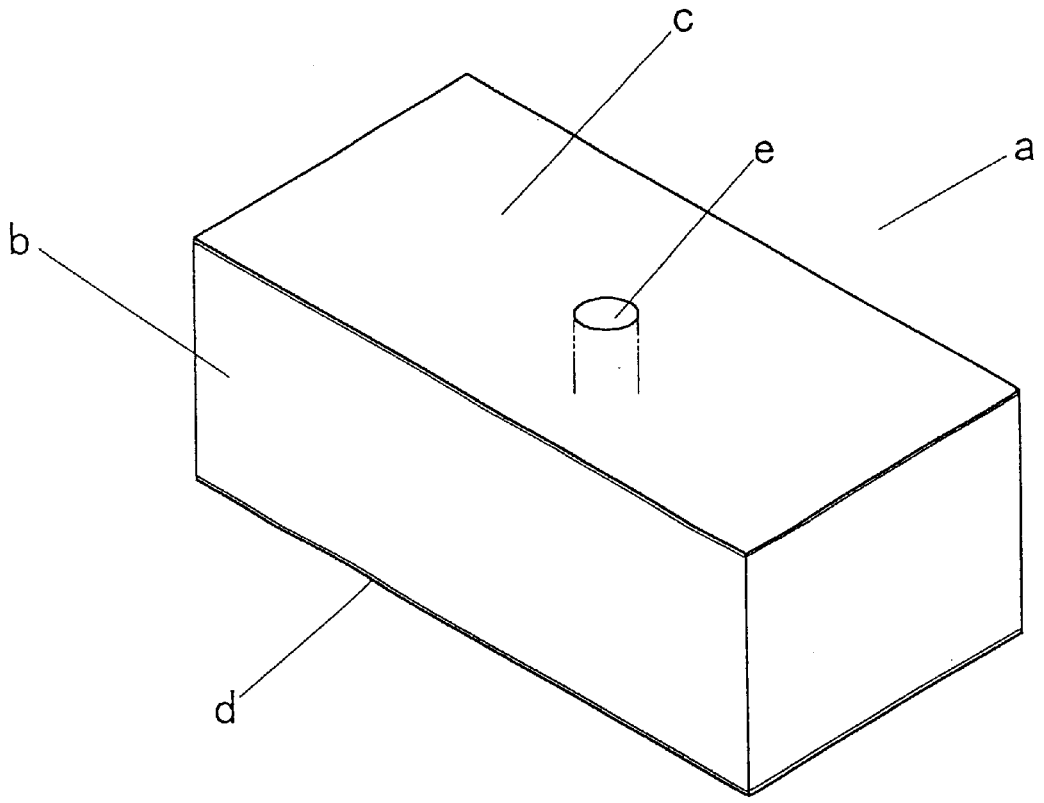
FIG. 7 (PRIOR ART)
FIG. 7 is, as described above, a perspective view showing a conventional micro-strip antenna.

The characteristics of the micro-strip antenna 1*a* shown in FIG. 1 have been examined as a function of the length of the reactance compensation electrode 10*a*. FIGS. 5A to 5C are graphs showing the reflection characteristics for three different lengths of the reactance compensation electrode 10*a*. FIGS. 6A to 6C are Smith charts for three different lengths of the reactance compensation electrode 10*a*. The Smith charts are plots of the impedance characteristics as a function of frequency. In the Smith charts, the region of the upper semicircle indicates that an inductance component is relatively large, while the region of the lower semicircle indicates that a capacitance component is relatively large.

FIGS. 5A and 6A show the case where the length d is 5.36 mm. In this case, the input impedance was 44.2Ω.

FIGS. 5B and 6B show the case where the length d is 5.13 mm. In this case, the input impedance was 47.5Ω.

FIGS. 5C and 6C show the case where the length d is 4.94 mm. In this case, the input impedance was 49.8Ω. This indicates that, through the use of a length d of 4.94 mm, the input impedance of the micro-strip antenna 1*a* matches the 50Ω feed line, thereby optimizing efficiency in transmission or reception of electromagnetic waves.

As can be seen in FIGS. 5 and 6, the input impedance can be adjusted so as to match the 50Ω feed line, through modification of the length of the reactance compensation electrodes 10*a* to 10*d*.

The reactance compensation electrodes 10*a* to 10*d* are screen-printed in a predetermined shape that matches the 50Ω feed line. Since the reactance compensation electrodes 10*a* to 10*d* are formed on the dielectric substrate 2 in an exposed manner, i.e., on an exposed side surface of the dielectric substrate 2, after formation thereof, the input impedance can be adjusted through modification of the electrodes, for example, by shortening or truncation thereof. Further, the length of the formed reactance compensation electrodes 10*a* to 10*d* may be increased to provide input impedance adjustment, through the addition of a conductor to an end portion thereof.

The micro-strip antennas 1*a* to 1*c* are each mounted on a printed circuit substrate on which a feed circuit is printed, and the feed circuit is electrically connected to the radiation conductor 3 via the feed electrode 8 and the inner conductor 6 formed on the wall of the through-hole 5.

It will be obvious to those skilled in the art that numerous modifications and variations of the present invention as described above are possible in light of the foregoing teachings. It is therefore to be understood that within the scope of the appended claims, the present invention may be practiced otherwise than as specifically described herein.

What is claimed is:

1. A micro-strip antenna comprising:

a dielectric substrate having first and second opposed main faces, and at least one side face;

a radiation conductor disposed on the first main face of said dielectric substrate;

a ground conductor disposed on the second, opposed main face of said dielectric substrate;

a through hole extending through said dielectric substrate between said opposed main faces and defining an inner wall;

an inner conductor formed on said inner wall;

a feed electrode formed on said second main face, said feed electrode being connected to said inner conductor and being insulated from said around conductor, and a reactance compensation electrode disposed on the side face of said dielectric substrate and connected to one of said radiation conductor and said ground conductor.

2. A micro-strip antenna according to claim 1, wherein said electrode is connected to the radiation conductor.

3. A micro-strip antenna according to claim 1 wherein said electrode is connected to the ground conductor.

4. A micro-strip antenna according to claim 1, wherein said reactance compensation electrode includes a strip electrode portion disposed in parallel with the main faces of said dielectric substrate.

5. A micro-strip antenna comprising:

a dielectric substrate having first and second opposed main faces and at least one side face;

a radiation conductor disposed on the first main face of said dielectric substrate;

a ground conductor disposed on the second, opposed main face of said dielectric substrate; and a first reactance compensation electrode connected to said ground conductor and a second reactance compensation electrode connected to said radiation conductor, said first and second reactance compensation electrodes being disposed on said side face of said dielectric substrate and being arranged in a mutually opposing relation.

6. A micro-strip antenna according to claim 5, wherein each said reactance compensation electrode includes a strip electrode portion disposed in parallel with the main faces of said dielectric substrate.

7. A micro-strip antenna according to claim 5 further comprising a through hole extending through said dielectric substrate between said opposed main faces and defining an inner wall;

an inner conductor formed on said inner walls; and a feed electrode formed on said second main face, said feed electrode being connected to said inner conductor and being insulated from said ground conductor.

* * * * *